US005860707A

United States Patent [19]

Keleny

[11] Patent Number: 5,860,707

[45] Date of Patent: Jan. 19, 1999

[54] IN-LINE SKATE WHEEL

[75] Inventor: Lloyd Gerhardt Keleny, Champlin, Minn.

[73] Assignee: Rollerblade, Inc., Minneapolis, Minn.

[21] Appl. No.: 816,849

[22] Filed: Mar. 13, 1997

[51] Int. Cl.[6] ..... B60B 5/02

[52] U.S. Cl. ..... 301/5.3; 301/64.7; 152/8; 152/323

[58] Field of Search ..... 301/5.3, 5.7, 64.7; 280/11.19, 11.22, 11.23; 152/1, 5, 7, 8, 9, 10, 323, 324, 325, 326, 327, 328, 329, 151, 246

[56] References Cited

U.S. PATENT DOCUMENTS

| | | | |
|---|---|---|---|
| 243,979 | 7/1881 | Ross . | |
| 282,156 | 7/1883 | Burton . | |
| 284,009 | 8/1883 | Henry . | |
| 285,836 | 10/1883 | Otis . | |
| 320,774 | 6/1885 | Gardner . | |
| 321,873 | 7/1885 | Wicker . | |
| 1,687,113 | 10/1928 | Stockdale . | |
| 2,570,349 | 10/1951 | Kardhordo . | |
| 2,878,071 | 3/1959 | Fowlkes . | |
| 3,396,773 | 8/1968 | Alderfer . | |
| 3,574,317 | 4/1971 | Brewer . | |
| 3,854,516 | 12/1974 | Burnell . | |
| 3,936,061 | 2/1976 | Wada . | |
| 3,987,832 | 10/1976 | Funke . | |
| 4,033,395 | 7/1977 | Berg et al. | 152/327 X |
| 4,040,670 | 8/1977 | Williams . | |
| 4,058,152 | 11/1977 | Beck et al. . | |
| 4,294,491 | 10/1981 | Black . | |
| 4,472,340 | 9/1984 | Boden et al. . | |
| 4,699,432 | 10/1987 | Klamer . | |
| 4,855,096 | 8/1989 | Panaroni . | |
| 4,909,972 | 3/1990 | Britz . | |
| 4,940,445 | 7/1990 | DesPortes . | |
| 4,966,212 | 10/1990 | Hill . | |
| 5,018,795 | 5/1991 | Engerand et al. . | |
| 5,028,058 | 7/1991 | Olson . | |
| 5,073,444 | 12/1991 | Shanelec . | |
| 5,080,444 | 1/1992 | Hopkins et al. . | |
| 5,092,614 | 3/1992 | Malewicz . | |
| 5,129,709 | 7/1992 | Klamer . | |
| 5,186,676 | 2/1993 | Morton | 301/64.7 X |
| 5,265,659 | 11/1993 | Pajtas et al. | 152/323 X |
| 5,310,250 | 5/1994 | Gonsior . | |
| 5,312,165 | 5/1994 | Spletter . | |
| 5,320,418 | 6/1994 | Chen . | |
| 5,351,974 | 10/1994 | Cech . | |
| 5,362,075 | 11/1994 | Szendel . | |
| 5,401,037 | 3/1995 | O'Donnell et al. . | |
| 5,411,320 | 5/1995 | Alderman et al. . | |
| 5,503,466 | 4/1996 | Lew . | |
| 5,527,100 | 6/1996 | O'Donnell et al. . | |
| 5,567,019 | 10/1996 | Raza et al. . | |
| 5,573,309 | 11/1996 | Bekessy . | |
| 5,630,891 | 5/1997 | Peterson et al. . | |
| 5,632,829 | 5/1997 | Peterson et al. | 152/329 X |
| 5,641,365 | 6/1997 | Peterson et al. . | |

FOREIGN PATENT DOCUMENTS

| | | |
|---|---|---|
| 295 081 | 12/1988 | European Pat. Off. . |
| 571 629 A1 | 12/1993 | European Pat. Off. . |
| 714 682 A2 | 6/1996 | European Pat. Off. . |
| 1036857 | 9/1953 | France . |
| 628872 | 4/1936 | Germany . |
| 1 031 192 | 5/1958 | Germany . |
| MI 92U/0823 | 12/1994 | Italy . |
| MI 92U/0824 | 12/1994 | Italy . |
| 530 804 | 5/1973 | Switzerland . |
| WO 80/00236 | 2/1980 | WIPO . |

OTHER PUBLICATIONS

Photographs of Hyper Wheel containing hollow tube.

*Primary Examiner*—Russell D. Stormer
*Attorney, Agent, or Firm*—Merchant, Gould, Smith, Edell, Welter & Schmidt, P.A.

[57] ABSTRACT

An in-line skate wheel includes an polyethylene closed cell foam ring surrounding the outer cylindrical surface of a hard plastic hub. Polyurethane is molded onto the outer cylindrical surface of the hub and surrounding the polyethylene ring. The polyethylene ring is provided with a substantially lower density than the density of the polyurethane.

8 Claims, 4 Drawing Sheets

IN-LINE SKATE WHEEL

I. BACKGROUND OF THE INVENTION

1. Field of the Invention

This invention pertains to in-line roller skates and more particularly to an improved wheel for use with in-line roller skates.

2. Description of the Prior Art

In recent years, in-line skating has become enormously popular. Such skates include a plurality of wheels mounted for rotation in a common plane. The axles of the wheels are mounted in parallel spaced-apart alignment.

Traditionally, in-line skate wheels include a rigid cylindrical plastic hub through which axles pass. Polyurethane is then molded onto the outer cylindrical surface of the hub to form a complete wheel. An example of such a construction is shown in U.S. Pat. No. 5,567,019 to Raza et al dated Oct. 22, 1996.

Polyurethane is a very dense material having a density of about 1.02 to 1.2 grams per cubic centimeter. Not uncommonly, a single in-line skate may have four wheels such that a pair of skates will have eight wheels. Accordingly, the wheels can comprise a significant part of the weight of the skate.

To improve comfort and performance of skates, weight reduction is an important goal of in-line skate design. Due to the significant percentage of a skate's weight associated with the wheels, weight reduction of wheels is desirable. Also, it is desirable to maintain the performance of the wheels including bounce, rolling resistance and rebound action.

One design which results in reduced weight of the wheel is to provide a flexible hollow tube in the form of a ring surrounding the hub. A polyurethane tire is molded onto the hub surrounding the hollow tube. Since the tube is hollow, the air volume of the tube is at a substantially lower density than the molded polyurethane resulting in reduced weight loss of the wheel. However, such a design is unsightly. Also, the design is not sufficiently flexible to permit modification of the performance by varying the design parameters. It is an object of the present invention to provide an enhanced wheel design with reduced weight, acceptable performance, attractive appearance and susceptible of selective modification to selectively adjust performance of the wheel.

II. SUMMARY OF THE INVENTION

According to a preferred embodiment of the present invention, a skate wheel is disclosed which includes a generally cylindrical hub having an axle opening. An outer layer of a first synthetic plastic material is molded onto the hub surrounding an outer cylindrical surface of the hub. The outer layer has a material of a first density. An inner layer of a second synthetic plastic having a density less than that of the outer layer material is provided surrounding the cylindrical surface and spaced from the axial ends of the hub. The first material surrounds the second material at both the radially outer and axially outer surfaces of the second material.

III. BRIEF DESCRIPTION OF THE DRAWINGS

IV. DESCRIPTION OF THE PREFERRED EMBODIMENT

Referring now to the several drawing figures in which identical elements are numbered identically throughout, a description of the preferred embodiment of the present invention will now be provided.

The present invention is directed toward an in-line skate wheel 10. The wheel 10 includes a hub 12, a foam core ring 14 and a molded polyurethane tire 16.

Figure 1:
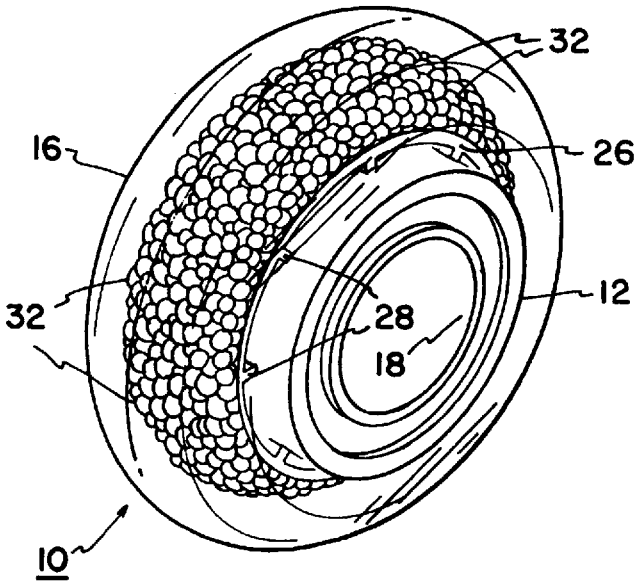
FIG. 1 is a perspective view of an in-line skate wheel according to the present invention.
Figure 5:
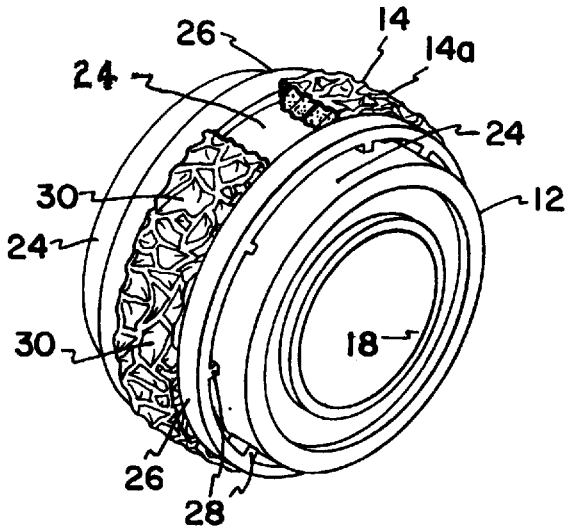
FIG. 5 is a perspective view of a hub and ring with the ring shown partially cut away to expose an interior cross-section.
Figure 4:
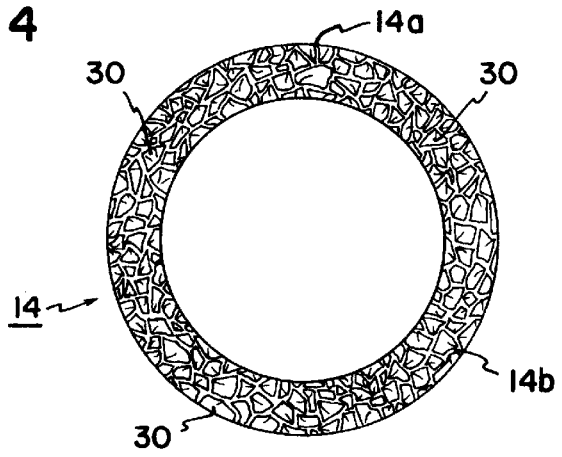
FIG. 4 is a side elevation view of a foam ring for use in the present invention.
Figure 3:
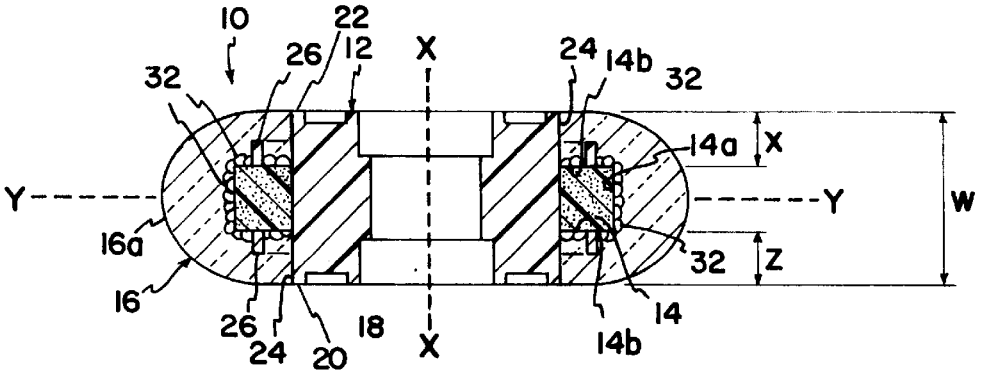
FIG. 3 is a view taken along line 3—3 of FIG. 2.
Figure 2:
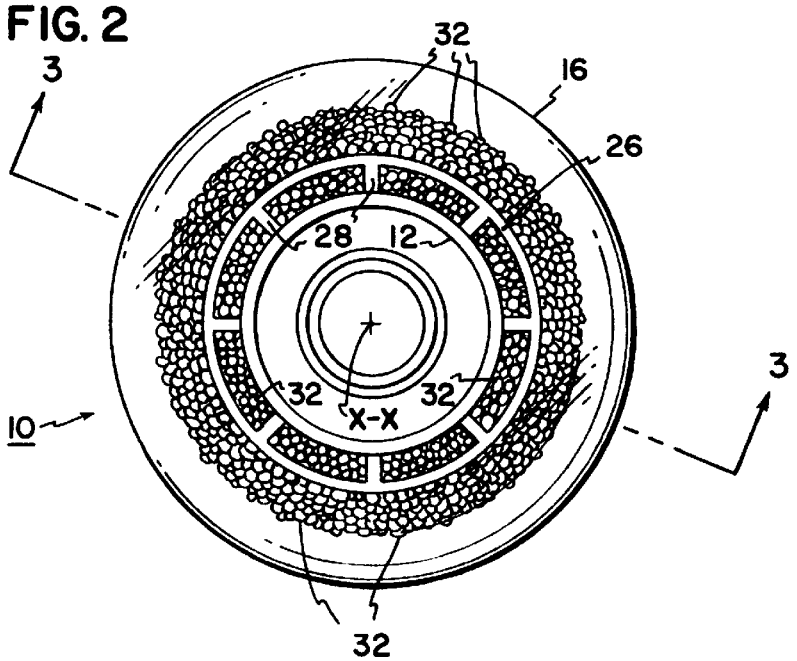
FIG. 2 is a side elevation view of the wheel of FIG. 1 (with the opposite side being substantially identical in appearance)
Figure 6:
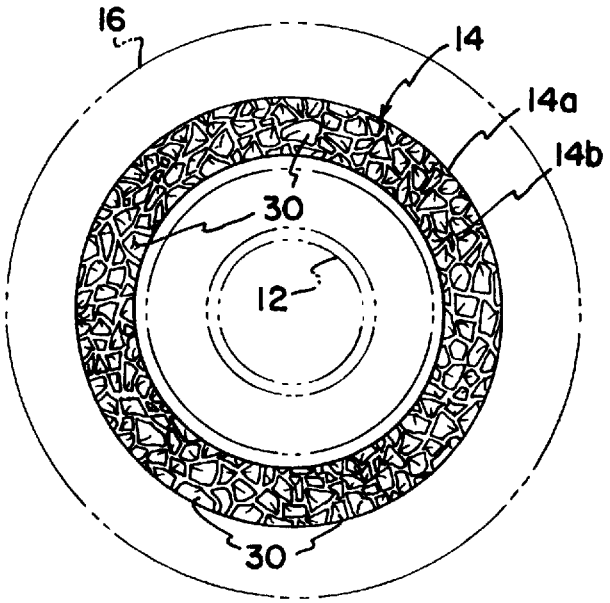
FIG. 6 is a side elevation view of the ring of FIG. 4 with the polyurethane wheel and the plastic hub shown in phantom lines for purposes of illustration.
Figure 7:
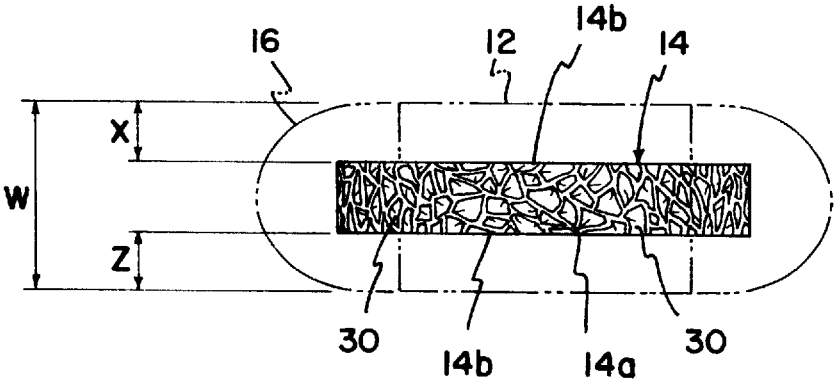
FIG. 7 is a top plan view of the view of FIG. 6.
Figure 8:
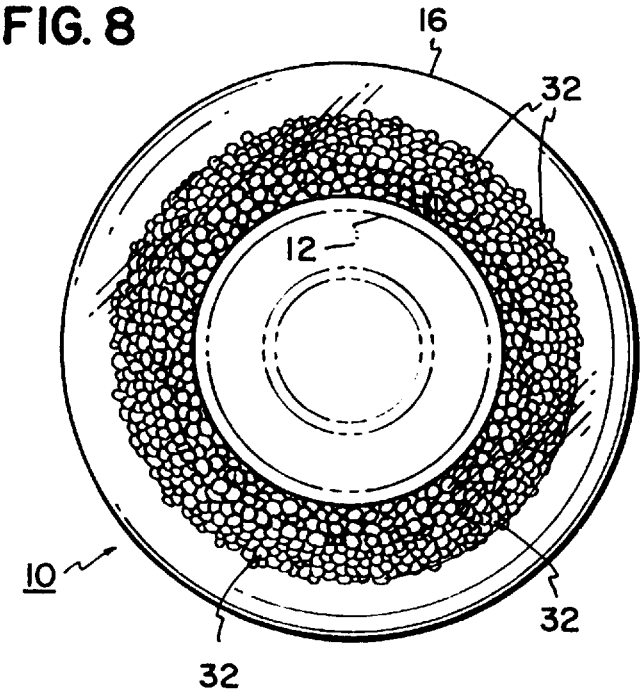
FIG. 8 is a side elevation view of a wheel according to the present invention with internal hub shown in phantom lines for purposes of clarity of illustration.

The hub 12 is conventional. The hub 12 is molded of hard rigid plastic such as nylon, thermoplastic polyurethane and other thermal plastics. The hub 12 has an axially extending bore 18 extending along an axis X—X of the hub 12 from a first axial end 20 to a second axial end 22 (FIG. 3). An outer surface 24 of the hub between the axial ends 20 and 22 is a generally cylindrical.

An outer layer (or tire) of a first synthetic plastic material such as polyurethane 16 is molded onto the hub 12 surrounding the cylindrical surface 24. The polyurethane tire 16 has a progressively increasing radial dimension (i.e., the distance from the axis X—X to the outer surface 16*a* of the tire 16) from the axial ends 20, 22 toward the center of the wheel at a central dividing plane Y—Y (extending centrally between and parallel to ends 20,22).

When molding the polyurethane 16, the molten polyurethane 16 forms a chemical bond, a mechanical bond, or both chemical and mechanical bonds with the hub 12. The polyurethane has a density of about 1.02 to 1.2 grams per cubic centimeter.

To resist sheer forces between the polyurethane 16 and the surface 24, anchors 26 are provided. The anchors 26 are integrally molded with the hub material and are rings 26 which are parallel and spaced apart on opposite sides of a center plane Y—Y of the hub and spaced from the surface 24 by ribs 28. With the anchors 26, the molded polyurethane 16 may flow into the spaces defined between the rings 26, surface 24 and ribs 28 to provide a mechanical anchor for the polyurethane tire 16 in addition to any chemical or mechanical bonding between the polyurethane 16 and the surface 24. The use of anchors is particularly desirable with nylon hubs since polyurethane does not bond well with nylon. While the present embodiment illustrates the use of the present invention with polyurethane 16 secured by anchors 26, it will be appreciated that the present invention is applicable to a wheel construction which does not include such anchors 26 but merely provides the polyurethane 16 bonded directly to the hub cylindrical surface 24.

An inner layer of a second synthetic plastic material is provided in the form of a foam core ring 14. The foam core ring 14 is centrally positioned between the ends 20, 22 such that the ring 14 is centrally positioned on the plane Y—Y between anchors 26 and with the ring 14 abutting the surface 24.

The ring 14 is formed of a material having a density which is less than the density of the polyurethane 16. In a preferred embodiment, the ring 14 is a closed cell polyethylene foam having a density of about 0.03 grams per cubic centimeter. While closed cell polyethylene is the preferred material, other materials could be used to form the ring including molded expanded polystyrene. It is desirable that the material of the inner layer 14 have a melting point less than the melting point of the polyurethane 16 to permit the polyurethane 16 to be molded around the ring 14.

As illustrated best in FIG. 3, the molded polyurethane 16 flows to surround the outer cylindrical surface 14*a* of the ring 14 as well as the axial sides 14*b* of the ring 14. Further, the molded polyurethane is directly bonded to the hub at surface 24 on opposite sides of the ring 14.

Direct bonding of the polyurethane 16 to the hub 12 is desirable since polyurethane 16 does not readily bond with the polyethylene ring 14. Instead, the polyethylene is captured within the polyurethane which is in turn, bonded to the hub 12.

In a preferred embodiment, about ½ to ⅔ of the axial length of the surface 24 is bonded directly to the polyurethane 16 such that between ¼ and ⅓ of the axial length is bonded directly to the polyurethane on both of the opposite sides of the ring 14. In other words (and with reference to FIG. 3), the combined length of dimensions Z and X (the length of direct bonding to surface 24) is about ½ to ⅔ of the total width W of the polyurethane 16. Such a degree of direct bonding provides sufficient bonding to resist sheer stress resulting from use of the wheel 10 where the hub has a length of about 1 inch (about 24 millimeters). Also, the cross-sectional area of the ring 14 is about ½ of the cross-sectional area of the tire 16. This provides a substantial amount of volume reduction by the lower density ring 14 to greatly reduce the weight of the wheel 10. Since the weight of the wheel 10 is so reduced, a harder durometer polyurethane 16 can be utilized without increasing the weight of the wheel 10 but to provide a lower rolling resistance and maintaining the perceived rebound and action of a solid wheel 10.

As previously mentioned, the foam core ring 14 is preferably closed cell polyethylene. The closed cell structure has a plurality of non-communicating cells 30 to limit the polyurethane 16 from flowing into and filling the foam core ring 14. Further, the closed cell structure of the ring 14 results in a plurality of cells 30 being exposed on the external surfaces of the ring 14. The molded polyurethane 16 can flow into the cells 30 to provide an additional mechanical anchor between the polyurethane tire 16 and the ring 14.

When the polyurethane 16 is molded onto the hub 12 and ring 14, the polyurethane 16 has a temperature of about 180°–220° F. This temperature expands the air within the cells 30 of the ring 14. The expanded air attempts to migrate out of the ring 14 and forms numerous bubbles 32 on the external surface of the ring 14. With the use of a clear or transparent polyurethane 16, the bubble formation results in an aesthetically pleasing appearance to the wheel 10.

The polyurethane ring 14 may not have precise external geometries and may have surface imperfections. The formation of numerous bubbles 32 on the surface of the polyurethane 14 masks the unsightly foam core 14 as well as masking any surface imperfections.

Further, the bubble layer 32 provides an intermediate layer of lowest density (i.e., air) between the higher density polyurethane 16 and the low density polyethylene 14. As a result, numerous design options are possible. For example, to modify either appearance or performance, the material of the foam core ring 14 (i.e., cell size etc.) may be modified. In a prior art designs consisting solely of molded polyurethane 16, a person attempting to modify the performance of the wheel 10 was restricted in the available design parameters. Namely, such a designer could modify the geometry or the particular selection of the polyurethane to modify performance. In addition to having the option of modifying these design parameters, with the present invention, a designer can modify the geometry and selection of the material of the foam core ring 14. This gives additional factors which can be modified to enhance the designer's option for modifying the performance or appearance of a wheel 10. The addition of the bubble layer 32 is still a third feature such that the size of the bubbles 32 can be modified and the amount of migration of the bubbles 32 into the polyurethane 16 can be modified by affecting the cure rate of the polyurethane. Therefore, a greatly enhanced design flexibility is provided with the present invention for making wheels of a wide degree of bounce, appearance, hardness or the like.

While the present invention has been described with respect to a polyethylene foam, it has been mentioned that the ring could be an extended polystyrene. While no bubbles would form with an expanded polystyrene, such a ring could be easily cast into a wide variety of geometries.

Figure 9:
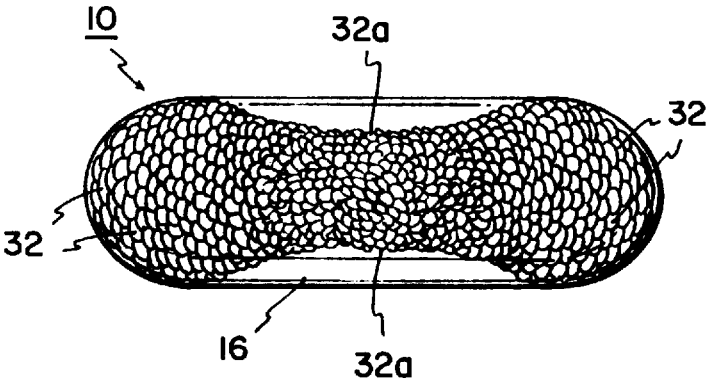
FIG. 9 is a top plan view of wheel of FIG. 8.

In the figures, the bubble field 32 is shown surrounding the ring 14 and masking the ring 14 from view. It should be noted in FIG. 9 that the bubble field 32 has an hour-glass appearance resulting in concave sidewalls 32*a*. It will be appreciated that the illustration of FIG. 9 shows an illusion resulting from diffraction of light passing through the transparent polyurethane 16 from the bubble field 32 to give an illusion of curved walls 32*a*.

From the foregoing detailed description of the present invention it has been shown how the objects of the invention have been attained in a preferred manner. Modification and equivalents of the disclosed concepts such as those which readily occur to one skilled in the art are intended to be included within the scope of the claims which are appended hereto.

What is claimed is:

1. A skate wheel comprising:

a generally cylindrical hub having an axially extending axle opening, said hub further having first and second axial ends separated by a cylindrical surface;

an outer layer of a first synthetic plastic material having a first density, said first material molded onto said hub and surrounding said cylindrical surface;

an inner layer of a second synthetic plastic material having a second density less than said first density, said inner layer being generally centrally positioned surrounding said cylindrical surface and spaced from said axial ends;

said first material surrounding said second material on at least radially outer and axially outer surfaces of said second material with an outer surface of said first material having a progressively increasing radial dimension from said axial ends toward a center of said hub;

wherein said skate wheel further comprises a layer of entrained air bubbles between said inner and outer layers.

2. The skate wheel according to claim 1 wherein said outer layer is a molded polyurethane material and said inner layer includes an annular foam ring, said ring generally centrally positioned surrounding said cylindrical surface and spaced from said axial ends; wherein said molded polyurethane material is molded onto said hub and surrounds said cylindrical surface and said ring.

3. The skate wheel according to claim 2 wherein said foam is a closed cell foam.

4. A skate wheel comprising:

a generally cylindrical hub having an axially extending axle opening, said hub further having first and second axial ends separated by a cylindrical surface;

first and second anchors projecting radially outward from said cylindrical surface and extending circumferentially around said cylindrical surface, said first and second anchors defining a material receiving channel therebetween;

an outer layer of a first synthetic plastic material having a first density, said first material molded onto said hub and surrounding said cylindrical surface;

an inner layer of a second synthetic plastic material having a second density less than said first density, said inner layer being generally centrally positioned surrounding said cylindrical surface and received at least partially within said material receiving channel;

said first material surrounding said second material on at least radially outer and axially outer surfaces of said second material with an outer surface of said first material having a progressively increasing radial dimension from said axial ends toward a center of said hub;

wherein said outer layer is a molded polyurethane material and said inner layer includes an annular foam ring, said ring sized to be received in said material receiving channel and wherein said molded polyurethane material is molded onto said hub and surrounds said cylindrical surface, said first and second anchors and said ring.

5. A skate wheel comprising:

a generally cylindrical hub having an axially extending axle opening, said hub further having first and second axial ends separated by a cylindrical surface;

an outer layer of a first synthetic plastic material having a first density, said first material molded onto said hub and surrounding said cylindrical surface;

an inner layer of a second synthetic plastic material having a second density less than said first density, said inner layer being generally centrally positioned surrounding said cylindrical surface and spaced from said axial ends;

a middle layer interposed at least partially between said inner and outer layers and generally surrounding said inner layer, said middle layer having a third density less than said first and second densities; and said first material surrounding said second material on at least radially outer and axially outer surfaces of said second material with said middle layer at least partially interposed therebetween, wherein an outer surface of said first material has a progressively increasing radial dimension from said axial ends toward a center of said hub.

6. A skate wheel according to claim 5 wherein said outer layer is a molded polyurethane material and said inner layer includes an annular foam ring, said ring generally centrally positioned surrounding said cylindrical surface and spaced from said axial ends; wherein said molded polyurethane material is molded onto said hub and surrounds said cylindrical surface and said ring.

7. A skate wheel according to claim 6 wherein said foam is a closed cell foam.

8. A skate wheel according to claim 5 wherein said middle layer includes entrained air bubbles.

* * * * *